US005760805A

United States Patent [19]

Binnert et al.

[11] Patent Number: 5,760,805

[45] Date of Patent: Jun. 2, 1998

[54] INK SUPPLY CONTAINER WITH IMPROVED FOAM RETENTION PROPERTIES

[75] Inventors: Thomas R. Binnert, Hammondsport; Vladimir M. Kupchik, Pittsford; Vincent J. Ouellette, Fairport, all of N.Y.

[73] Assignee: Xerox Corporation, Stamford, Conn.

[21] Appl. No.: 668,802

[22] Filed: Jun. 24, 1996

[51] Int. Cl.[6] ..... B41J 2/175; B65D 90/02

[52] U.S. Cl. ..... 347/86; 220/674

[58] Field of Search ..... 347/85, 86, 87; 220/674, 454, 457, 669, 611

[56] References Cited

U.S. PATENT DOCUMENTS

| | | | |
|---|---|---|---|
| Re. 32,572 | 1/1988 | Hawkins et al. | 156/626 |
| 4,571,599 | 2/1986 | Rezanka . | |
| 4,771,295 | 9/1988 | Baker et al. . | |
| 4,833,491 | 5/1989 | Rezanka . | |
| 5,185,614 | 2/1993 | Courian et al. . | |
| 5,280,299 | 1/1994 | Saikawa et al. | 347/87 |
| 5,486,855 | 1/1996 | Carlotta et al. | 347/87 |

*Primary Examiner*—Benjamin R. Fuller
*Assistant Examiner*—Judy Nguyen

[57] ABSTRACT

An ink container for an ink printer is disclosed of the type wherein a foam member is seated within the ink container in which ink is drawn by capillary action through an ink outlet port in the container. The interior surface of the compartment of the container which seats the compressed foam has been treated so as to establish two areas of surface finish. A first area, adjacent the face of the container through which the foam is inserted, has a fine surface finish to prevent the foam from rebounding or bulging back through the entrance face following insertion. A second finish, in the more interior portion of the compartment, is relatively coarser and is designed to prevent the foam member from pulling away from interior corners and insures a more even distribution of the foam.

4 Claims, 4 Drawing Sheets

INK SUPPLY CONTAINER WITH IMPROVED FOAM RETENTION PROPERTIES

BACKGROUND OF THE INVENTION AND MATERIAL DISCLOSURE STATEMENT

The present invention relates to ink recording devices and, more particularly, to an improved ink supply container of the type that delivers ink to a printhead from an ink impregnated foam member stored within a compartment of the container.

Ink jet recording devices include one or more printheads which eject ink onto a print medium such as paper in controlled patterns of closely spaced dots. To form color images, multiple printheads are used, with each printhead being supplied with ink of a different color from an associated ink container. Thermal ink jet printing systems use thermal energy selectively produced by resistors located in capillary filled ink channels near channel terminating nozzles or orifices to vaporize momentarily the ink and form bubbles on demand. Each temporary bubble expels an ink droplet and propels it toward a recording medium. The printing system is generally incorporated in a carriage type printer. A carriage type printer generally has a relatively small printhead containing the ink channels and nozzles. The printhead is usually sealingly attached to an ink supply container and the combined printhead and container form a cartridge assembly which is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed.

Ink from the ink supply container is drawn by capillary action through an outlet port in the container and into a manifold fluidly connecting ink to the printhead. The manifold supplies ink to the ink channels replenishing the ink after each ink ejection or firing from the associated nozzle.

It is important that the ink at the nozzle be maintained at a negative pressure (sub-atmospheric pressure) so that the ink is prevented from dripping onto the recording medium unless a droplet is expelled by thermal energy. A negative pressure also advantageously ensures that the size of the ink droplets ejected from the nozzle remain constant as ink is depleted from the reservoir. The negative pressure is usually in the range of −0.5 to −2.0 inches. One known method of supplying ink at a negative pressure is to place within an ink container an open cell foam in which ink is suspended by capillary action. The foam is generally a partially saturated, reticulated urethane foam. The absorption of the foam member maintains the ink at a negative pressure at the printhead. Ink tanks which contain ink-holding foam are disclosed, for example, in U.S. Pat. No. 5,185,614, 4,771,295, 5,486,855.

When the foam member is initially placed within the ink container, it is typically compressed between 20 to 30% of its original volume in order to establish the compression and pore size necessary to initiate and maintain a capillary ink flow. One face of the ink container is left open so that the foam can be inserted. The face is then encovered with a foam cover which is seated to the abutting container walls and welded in place.

A problem with this type of foam deliver ink container is that the foam, once inserted into the holding compartment, tends to "rebound" to its original uncompressed state and protrudes slightly out of the compartment interfering with the seating of the foam cover and contaminating the sealing interface. Both conditions combine to produce a weld which is prone to leakage.

Another problem associated with compressing open cell foam within an internal cavity is that, as the foam attempts to rebound, it pulls away from internal corners leaving corner spaces devoid of foam cell structure. In this disrupted state, the foam becomes more compressed in certain areas relative to other areas resulting in differential ink saturation which negatively affects the foam's ability to consistently regulate ink delivery.

SUMMARY OF THE INVENTION

It is, therefore, one object of the invention to provide an ink container having an internal cavity in which a foam member can be inserted and compressed without the rebound effects hampering attachment of the foam cover.

It is another object of the invention to design the foam-holding cavity of the ink container so that the foam physically conforms to all internal surfaces of the cavity including corners.

These, and other objects, are realized by controlling interfacial friction between the internal surfaces of the container and the inserted foam. The interfacial friction at the container surface adjacent a portion of the foam entrance face is provided with a fine surface finish to produce a relatively high interfacial friction preventing the foam from rebounding outside the plane of the foam insertion opening. The interfacial friction at the container surface areas adjacent or near the corners is provided with a coarser surface finish to provide a relatively lower interfacial friction improving the foam's ability to distribute itself into, and fully fill, the cavity.

More particularly, the present invention relates to an ink supply container for holding a foam member which releases ink through an ink outlet port in said container, the ink container characterized by having first and second interior surface areas with a first and second finish, respectively, the first finish being relatively finer than the second finish.

DESCRIPTION OF THE INVENTION

Figure 1:
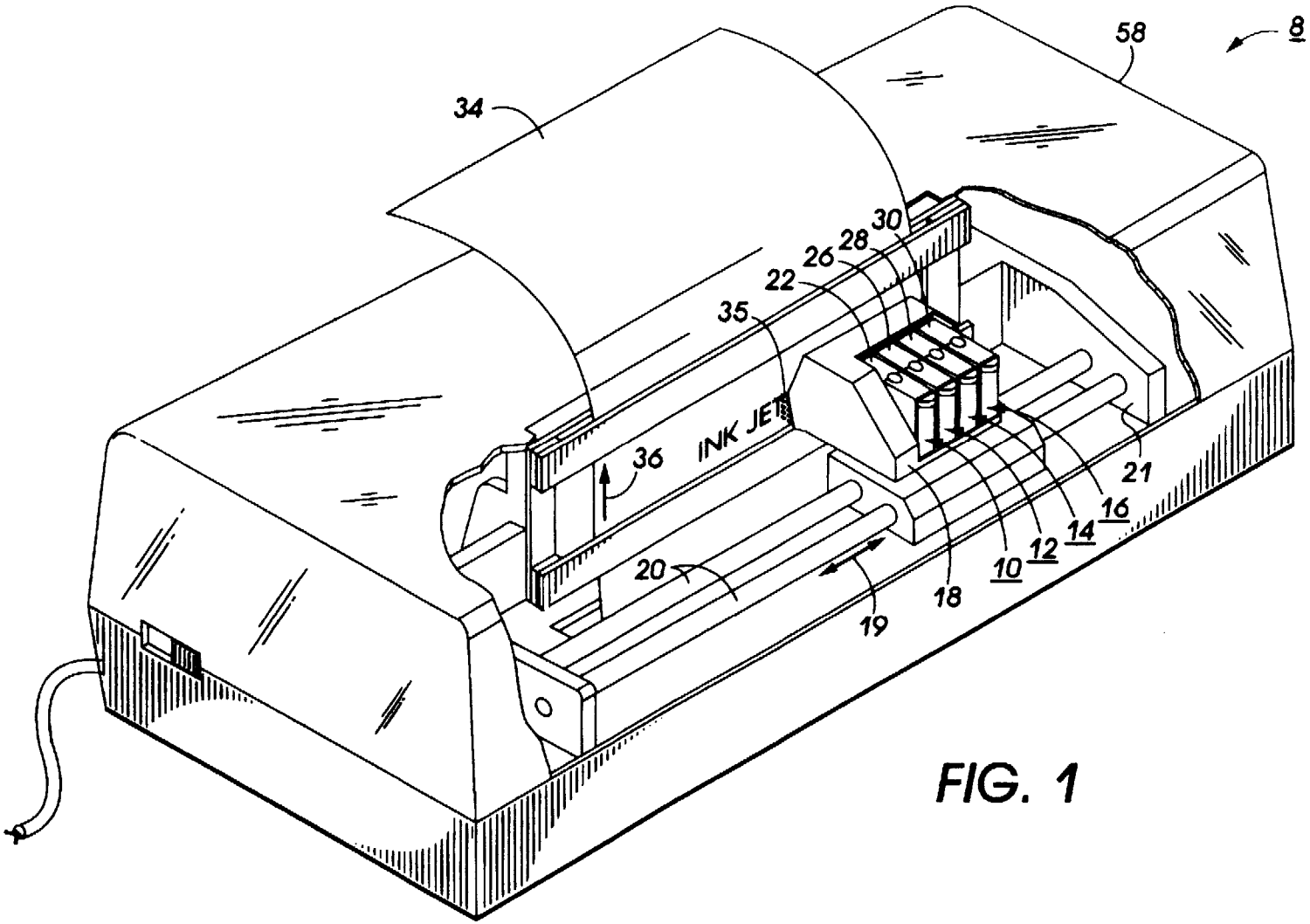
FIG. 1 illustrates a perspective view of a full color ink jet printer which incorporates the improved ink supply container of the present invention.

FIG. I illustrates a perspective view of a full color thermal ink jet printer 8 which incorporates a preferred embodiment of the foam retention ink containers of the present invention. Printer 8 is exemplary only. The invention can be practiced in other types of thermal ink jet printers as well as other reproduction devices such as piezoelectric printers, dot matrix printers and ink jet printers driven by signals from a document Raster Input Scanner. Printer 8 includes four ink jet printhead cartridges 10, 12, 14, 16 mounted on a carriage 18 supported by carriage rails 20. The carriage rails are supported by a frame 21 of the ink jet printer 8. Each printhead cartridge comprises an ink container containing ink for supply to a thermal ink jet printhead which selectively expels droplets of ink under control of electrical signals received from a controller (not shown) of the printer 8 through an electrical cable (not shown). In a preferred embodiment, the ink container is polypropylene.

Cartridge 10 comprises ink container 22 and printhead 24 (shown in FIG. 2); cartridge 12 comprises ink container 26 and an associated printhead (not visible); cartridge 14 comprises ink container 28 and an associated printhead (not visible), and cartridge 16 comprises ink container 30 and an associated printhead (not visible). Each container contains a different color ink which is fluidly connected to an associated printhead by a manifold 42 shown in side view in FIG. 2 and an exploded view in FIG. 3. Each printhead comprises a plurality of ink channels which carry ink from the associated container to respective ink ejecting orifices or nozzles. When printing, the carriage 18 reciprocates back and forth along the carriage rails 20 in the direction of the arrow 19, the entire width traverse constitutes a scanning path. The actual printing zone is contained within the scanning path. As the printhead cartridges 10, 12, 14, 16 reciprocate back and forth along a print path and past a recording medium 34, such as a sheet of paper or a transparency, droplets of ink 35 are expelled from selected ones of the printhead nozzles towards the sheet of paper. Typically, during each pass of the carriage 18 the recording medium 34 is held stationary. At the end of each pass, the recording medium 34 is stepped in the direction of the arrow 36. For a more detailed explanation of the operation of printer 8, reference is hereby made to U.S. Pat. Nos. 4,571,599, 4,833,491, and U.S. Pat. No. Reissue 32,572, which are incorporated herein by reference.

Figure 2:
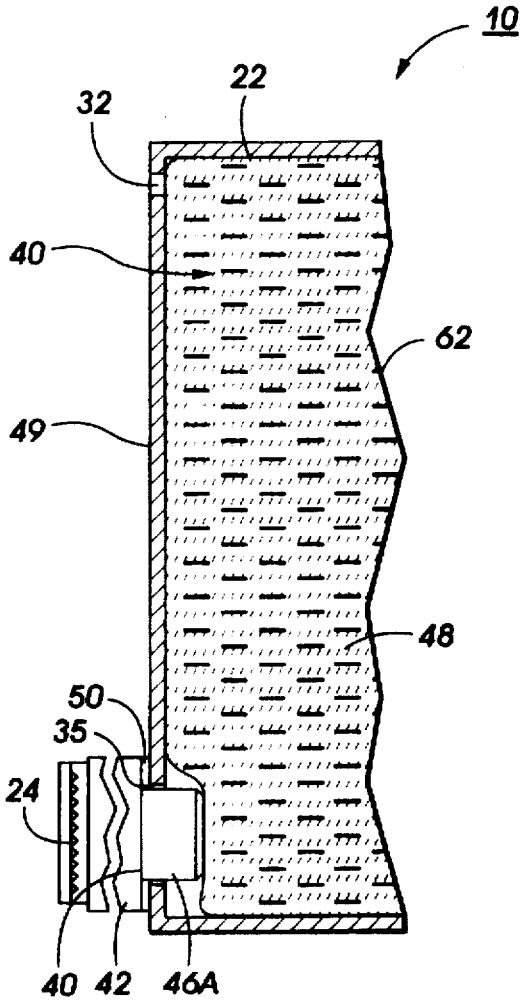
FIG. 2 is a cross-sectional view through one of the printhead cartridges shown in FIG. 1.

FIG. 2 shows a cross-sectional view of a portion of cartridge 10 showing ink container 22 having an outlet port 40 and an air inlet 32. Manifold member 42, shown in the perspective exploded view of FIG. 3, comprises a plate 44 with ink pipes 46A–46D. The end of ink pipe 46A is engaged in compressive contact (by means not shown) with an ink impregnated foam member 48 in container 22. Another foam member 50 has a plurality of apertures 52A–52D therethrough and is seated on manifold 42 so as to fit snugly over the ink pipes 46A–46D. When the manifold is in the operative position shown in FIG. 2, foam member 50 is compressed against the foam cover 49 of container 22.

Figure 3:
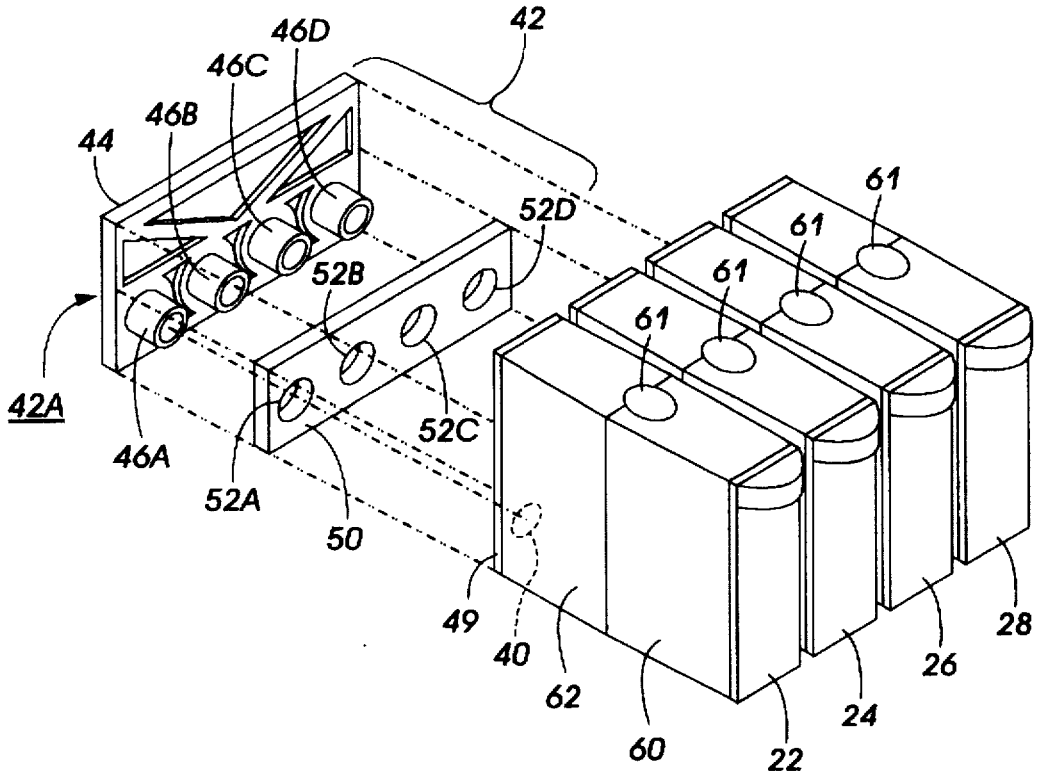
FIG. 3 is an exploded view of the manifold to ink tank arrangement of FIG. 1.
Figure 4:
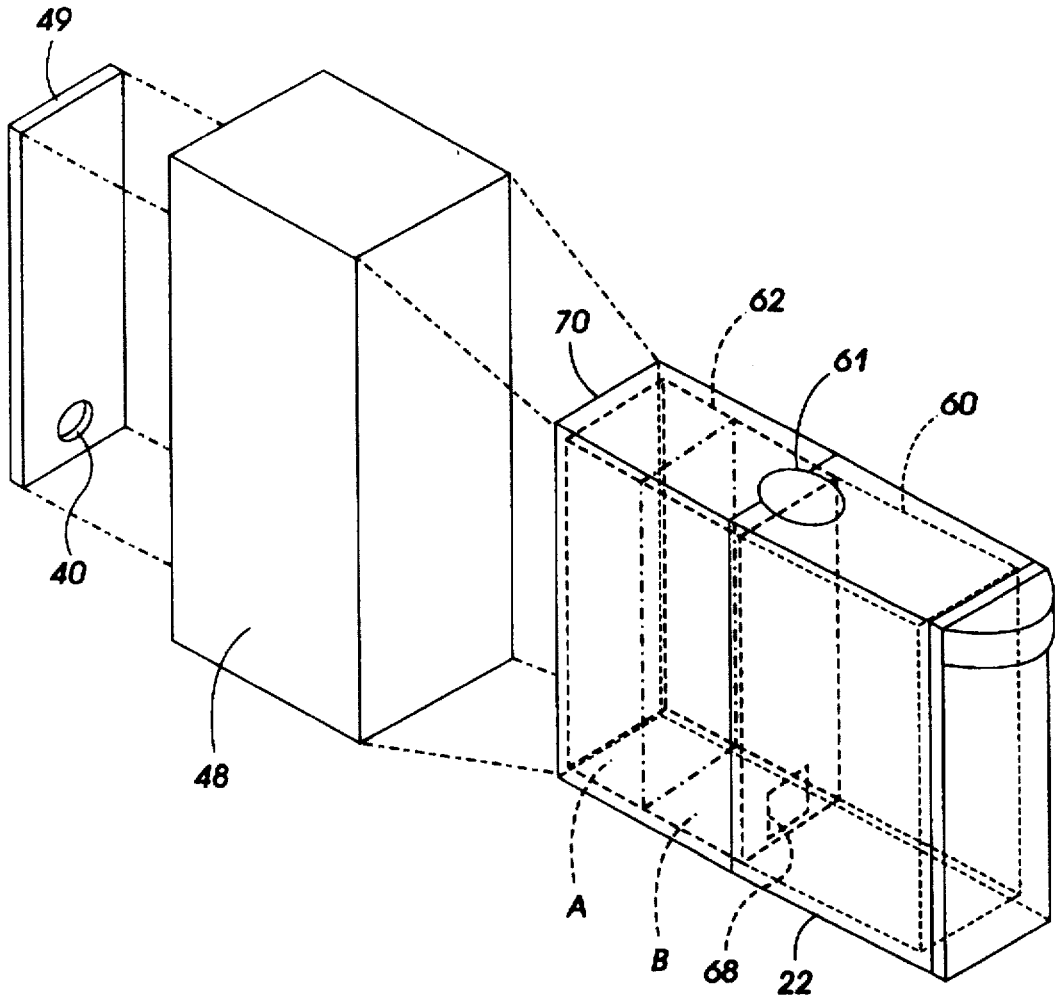
FIG. 4 is an exploded view of the ink tank prior to the foam insertion and ink filling steps.

As shown in FIGS. 3 and 4, each ink tank, represented by tank 22, contains two compartments. For tank 22, a first compartment 60 has ink stored therein. Ink is introduced through ink inlet 61. A second compartment 62 has open cell foam member 48 inserted therein. Ink from compartment 60 moves through port 68 to contact foam member 48 and saturate the member with ink. The foam member shown in FIG. 4 has 3.7 times the volume of compartment 62 so that the foam is compressed 27% of its original size. Referring to FIG. 4, and according to a first aspect of the invention, internal surface A (approximately the first the front half of compartment 62) has been provided with a surface finish less than SP1–SPE 3 and preferably between 1 and 2. According to a second embodiment of the invention, internal surface B (approximately the back half of compartment 62) has been provided with a surface finish of SP1–SPE 3 or greater. The different finished areas result in different or greater interfacial friction between the seated foam and the surfaces A and B finish. The frictional differences have been used to advantage to satisfy the aforementioned problems associated with the foam usage.

Referring to FIG. 4, the foam insertion procedure will be described together with an explanation of the differential friction consequences.

FIG. 4 shows container 22 having an open face 70 into which the foam 48 is to be inserted. Polypropylene foam cover 49 is welded into place following foam insertion. In order to insert the foam into the internal cavity 62 of the polypropylene ink tank, a fixture is used to compress the foam to 27% of its original size and then push the compressed foam into the cavity until the foam is fully bottomed. During the insertion operation, Teflon-coated fingers are used to compress the foam so that it does not physically contact the walls of the ink tank. This results in no static or dynamic load opposing the insertion motion Once the foam is fully bottomed, a pusher bar protrudes through the compression fingers to hold the foam in place within the cavity as the fingers are retracted. As noted above, the primary problem associated with this operation occurs at this point of the process. Compressed open-cell foam seeks to rebound to its original state thus physically exceeding the limits of the cavity. In this case, the result is foam springing back out of the cavity into a region of the ink tank reserved for ultrasonic welding of the foam cover 49. The foam thereby interferes with proper foam cover placement prior to welding and acts as a contaminant at the weld joint surface. However, because of the fine finish applied to area A, the foam is prevented from rebounding out of the cavity.

The relatively coarse finish of area B, on the other hand, allows the foam to be evenly distributed and extended into the upper and lower comers because of the relatively lower interfacial friction. Once the foam is properly inserted, cover 49 is welded into place, ink is introduced through inlet 61 until the foam is saturated and compartment 60 is filled with ink. The container is then ready to be seated over ink pipe 46A so that the pipe extends into compression with the foam. Conventional priming is then accomplished to introduce the ink into printhead 24.

While the optimum finish areas A and B have been described as occupying approximately one-half of compartment 62 respectively, the actual extent of the surface areas can be dependent on the type of foam used. And, while the entire internal surface areas have been provided with the described finishes, partially finished areas may prove satisfactory for some systems. SP1–SPE numbers are industry standard and represent surface roughness in microns. SP1–SPE 1 represents a surface finish of 0.1–0.18 microns roughness SP1–SPE 2 represents a surface finish of 0.18–0.2 microns roughness; SP1–SPE 3 represents a surface finish of 0.3–0.4 microns roughness. The finish may be accomplished by generally known methods such as vapor blasting and/or bead blasting of surface or polishing surface with 320 grit emery cloth. Polypropylene has a natural surface finish of 0.3–0.4 microns or SP1–SPE 3.

It is understood that the described embodiment is exemplary only. Other types of ink containers may be required for foam retention by the above-described technique. For example, certain ink supply printing systems may use only a single compartment ink container which contains an ink impregnated foam. Further, the ink flow may not be through ink pipes making compressive contact with the foam but may instead rely upon gravity flow coupled with capillary flow to cause ink to flow through an outlet port in the tank to the printhead.

While the embodiment disclosed herein is preferred, it will be appreciated from this teaching that various alternative, modifications, variations or improvements therein may be made by those skilled in the art, which are intended to be encompassed by the following claims:

We claim:

1. An ink supply for supplying ink to an ink jet printhead comprising:

an ink container having an ink outlet port for fluidly connecting to the printhead, the container having an Interior surface with a first and second finish, the first finish having a surface roughness of at least SP1–SPE 1 but no greater than SP1–SPE 3 and wherein the second finish has a surface roughness of at least, or greater than,SP1–SPE 3; and a foam member compressively seated within the container.

2. The ink supply of claim 1 wherein a portion of said interior surface having the first finish is adjacent the ink outlet port.

3. The ink supply of claim 2 wherein a portion of said interior surface having the first finish constitutes approximately one-half of said interior surface and a portion of said interior surface having the second finish constitutes a remainder of said interior surface and wherein an interfacial friction of the foam member against said interior surface evenly distributes the foam member into corners of the container.

4. An ink jet print cartridge comprising:

an ink jet printhead for ejecting ink droplets; an ink container having an ink outlet port fluidly connecting to the printhead, the container having an Interior surface with a first and second finish, the first finish having a surface roughness of at least SP1–SPE 1 but no greater than SP1–SPE 3 and wherein the second finish has a surface roughness of at least, or greater than, SP1–SPE 3; and a foam member compressively seated within the container.

* * * * *